US005097818A

United States Patent [19]

Kee et al.

[11] Patent Number: 5,097,818

[45] Date of Patent: Mar. 24, 1992

[54] STRUCTURE OF GAS GOVERNOR

[75] Inventors: Heui T. Kee; Seung H. Kim, both of Seoul, Rep. of Korea

[73] Assignee: SamSung Electronics, Co., Ltd., Suwon, Rep. of Korea

[21] Appl. No.: 554,924

[22] Filed: Jul. 20, 1990

[30] Foreign Application Priority Data

Jul. 20, 1989 [KR] Rep. of Korea ..... 89/10527
Aug. 1, 1989 [KR] Rep. of Korea ..... 89/11478

[51] Int. Cl.[5] ..... F24C 3/00
[52] U.S. Cl. ..... 126/39 E; 126/39 R; 126/39 N; 137/505.14
[58] Field of Search ..... 126/39 E, 52, 39 R, 126/39 N; 137/505.14, 505, 883, 861

[56] References Cited

U.S. PATENT DOCUMENTS

| | | | |
|---|---|---|---|
| 2,560,948 | 7/1954 | Hannibal et al. | 137/505.14 X |
| 3,525,554 | 8/1970 | Oberthür | 137/505.14 X |
| 3,540,428 | 11/1970 | Alvarez | 126/52 X |
| 3,995,626 | 12/1976 | Pearce, Jr. | 137/861 X |

*Primary Examiner*—Larry Jones
*Attorney, Agent, or Firm*—Bushnell, Robert E.

[57] ABSTRACT

In a gas governor for installation with a burner in a gas-fired appliance, all incoming gas is introduced into a common burner gas channel through a peripheral channel of a valve stem. A common burner gas channel branches into two channels to form a main burner channel and a pilot burner gas channel. By means of a flange integrally mounted around the outlet portion of main burner gas channel, the centerline of the main burner nozzle which is formed in the outlet of the main burner gas channel, may be coaxially aligned with the central axis of the venturi tube of main burner.

20 Claims, 7 Drawing Sheets

STRUCTURE OF GAS GOVERNOR

FIELD OF THE INVENTION

The present invention relates to a gas burner, and more particularly to a gas governor structure for supplying a gas controlled at an even pressure via a gas supply control, through a common burner gas channel formed to flow toward one predetermined direction, to a main burner and a pilot burner, respectively.

BACKGROUND OF THE INVENTION

A conventional gas burner as used in a stove, for example, has a safety valve serving in a role of a safety device for continuing or stopping the gas supply by using electromotive force produced, or lost, with a thermocouple, and a governor for injecting combustion fuel gas into a mixing room via a venturi tube under an even pressure.

Herein, some gas is fed from a gas valve through a gas pressure control into a main burner, while the remaining gas is fed from a gas valve into the pilot burner without passing through the gas pressure control.

Gas fed into main burner should be at an even gas pressure, while gas fed into a pilot burner is at an uneven gas pressure. Thus, a lifting phenomenon occurs at the pilot burner due to the uneven gas pressure. When flaming resulting from the lifting phenomenon is detected by a thermocouple, the electromotive force of the thermocouple is lowered, or lost, to thereby force a safety device to interrupt the supply of gas into the main burner. This phenomenon causes a deterioration of the function for performing the original object of the safety device, namely the function of stopping the fuel supply during an oxygen shortage, whenever that may happen in the vicinity of a gas stove, and thus impairs the reliability of the safety device.

In a structure in which the gas supplied to a main burner nozzle is injected into the interior of main burner through a venturi tube, the centerline of the main burner nozzle and the centerline of the venturi tube are not placed in a coaxial line; consequently, the air volume supplied to the main burner is relatively lower.

These phenomena lead to another problem which brings about incomplete combustion with an improper mixing ratio of air-to-combustion fuel.

SUMMARY OF THE INVENTION

It is an object of the present invention to provide a structure for a governor which provides an even and continuous flow of gas at a controlled pressure supplied to both a main burner and a pilot burner.

It is another object of the present invention to provide a structure for a governor which enhances the reliability of a safety device as gas is supplied into a pilot burner under an even and continuous pressure.

It is another object of the present invention to provide a structure for a governor having an attachment formed integrally as a single body, so as to coaxially align centerlines of a main burner nozzle and a main burner venturi tube, thereby supplying gas to main burner more efficiently.

These and other objects are achieved with a gas stove with a main burner and a gas governor. The gas governor includes a gas combustion apparatus provided with a venturi tube, a gas pressure control for controlling the discharging gas pressure, a housing provided with a valve stem for controlling gas intake volume in cooperation with the gas pressure control, a body coupled with the housing and having a main burner gas channel and a pilot burner gas channel formed therein, and an elbow having an inlet for intaking air from atmosphere and a receiving member for receiving the valve stem which is passed through the body. A gas governor structure enables gas received through the elbow to pass through the valve stem into a common burner gas channel (which branches into two channels) placed into the body in a direction perpendicular to the axial direction of the valve stem, and to further pass into the main burner gas channel and the pilot burner gas channel connected to the common burner gas channel, and to be emitted from a main burner nozzle and a pilot burner nozzle in two directions, thereby allowing the gas stove to have an even and continuous combustion at a main burner and a pilot burner.

More particularly, an attachment for the governor is placed at the periphery of the outlet on the common burner gas channel of the body so as to make it coaxial with the centerline of the main burner nozzle and the main burner venturi tube, so that the even and continuous combustion may be achieved at a main burner. Additionally, as gas from a supply passes only in same direction through the inside of the body, the space for installing the governor may be minimized.

The embodiments of the present invention enhance the stability and the reliability of operating a stove, because the gas pressure for the pilot burner is equal to the pressure of the main burner.

BRIEF DESCRIPTION OF THE DRAWINGS

The present invention will be described in detail by reference to the accompanying drawings, in which.

DETAILED DESCRIPTION OF THE INVENTION

Figure 1:
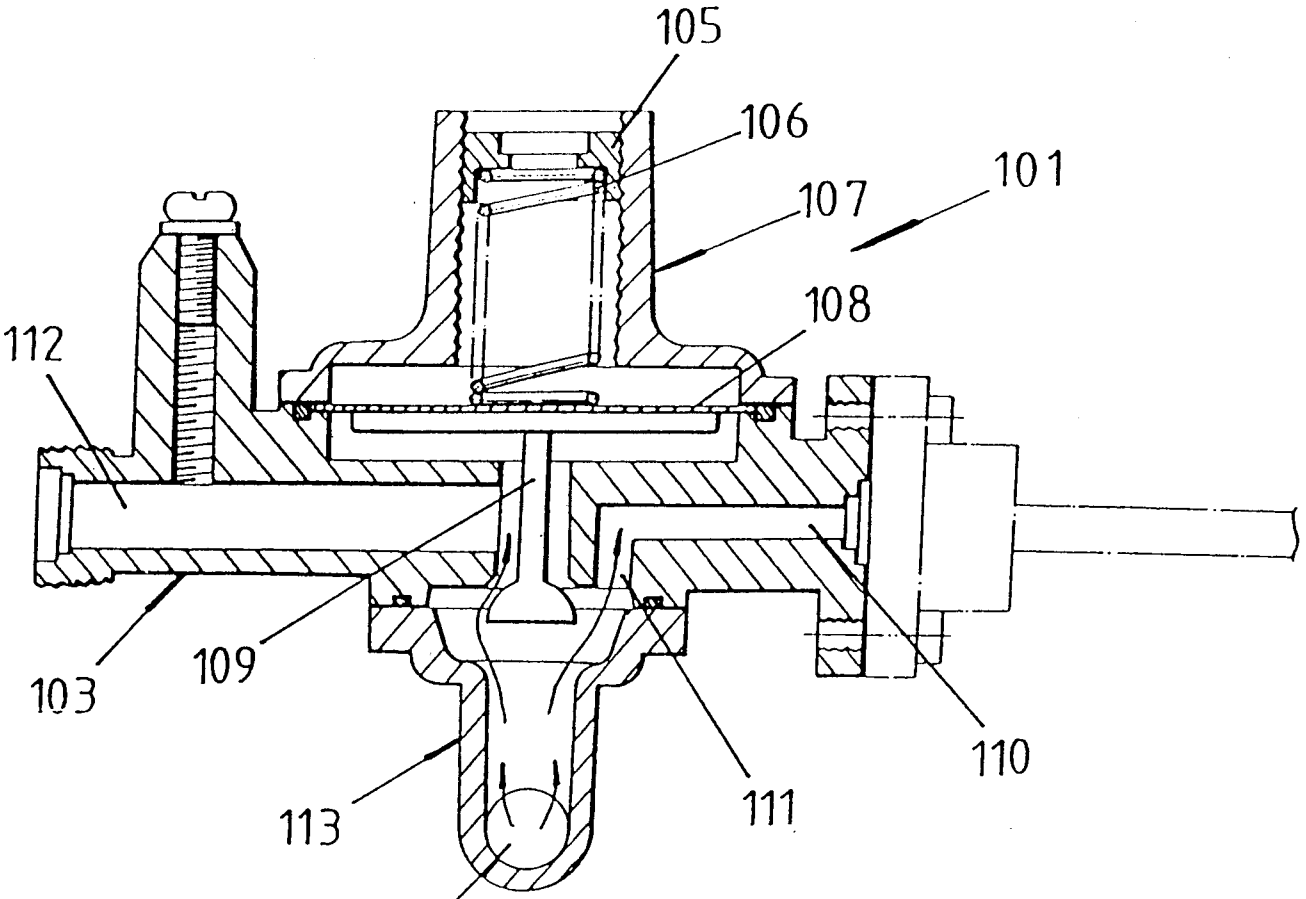
FIG 1 (PRIOR ART)
FIG. 1 is a sectional view illustrating a conventional governor structure.
Figure 2:
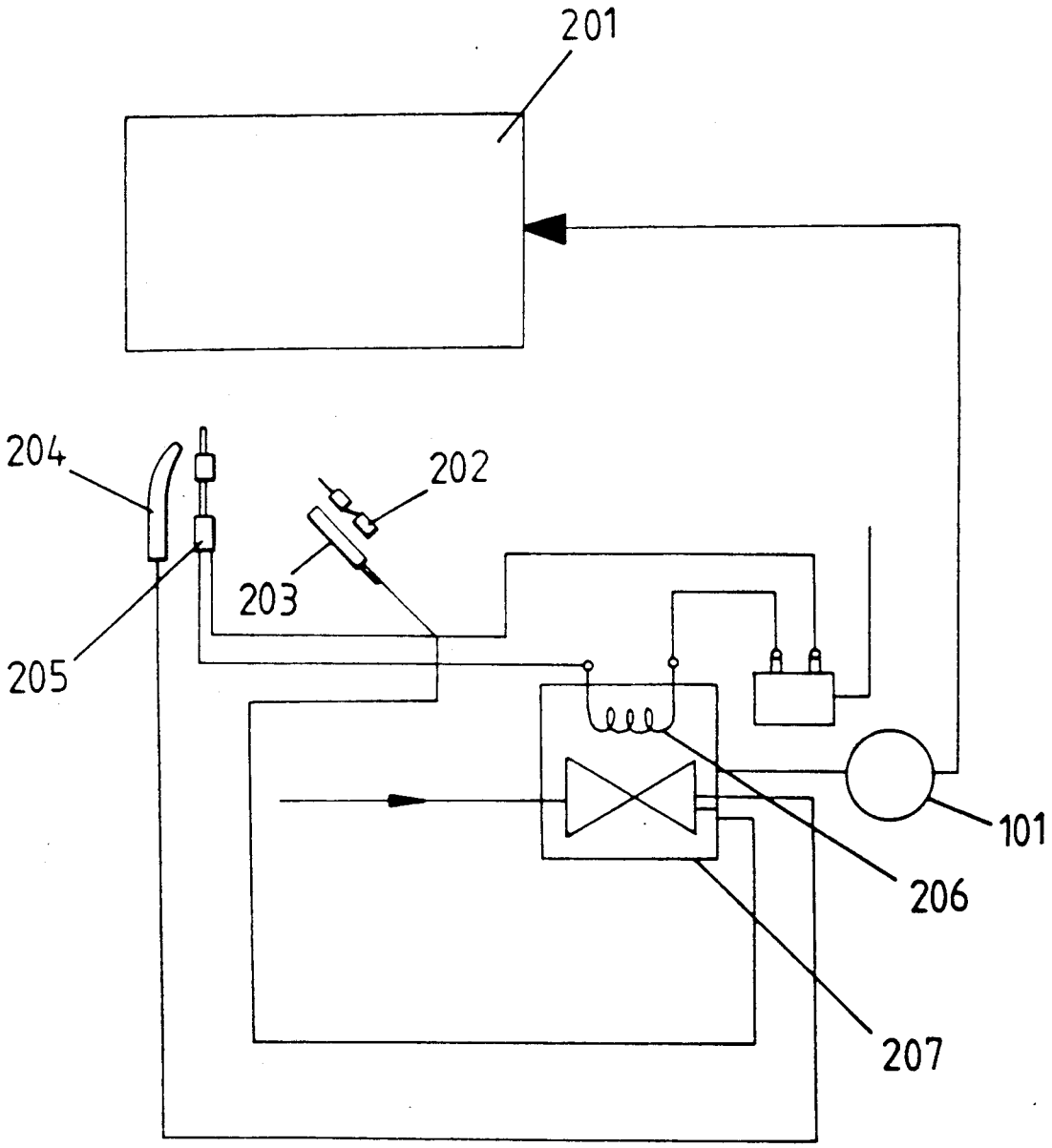
FIG 2 (PRIOR ART)
FIG. 2 is a schematic diagram of a gas supply circuit including a stove and a safety apparatus in the prior art.

Referring now to the drawings, FIG. 1 and FIG. 2 provide views illustrating a governor structure and a circuit diagram thereof according to prior art.

Figure 3A:
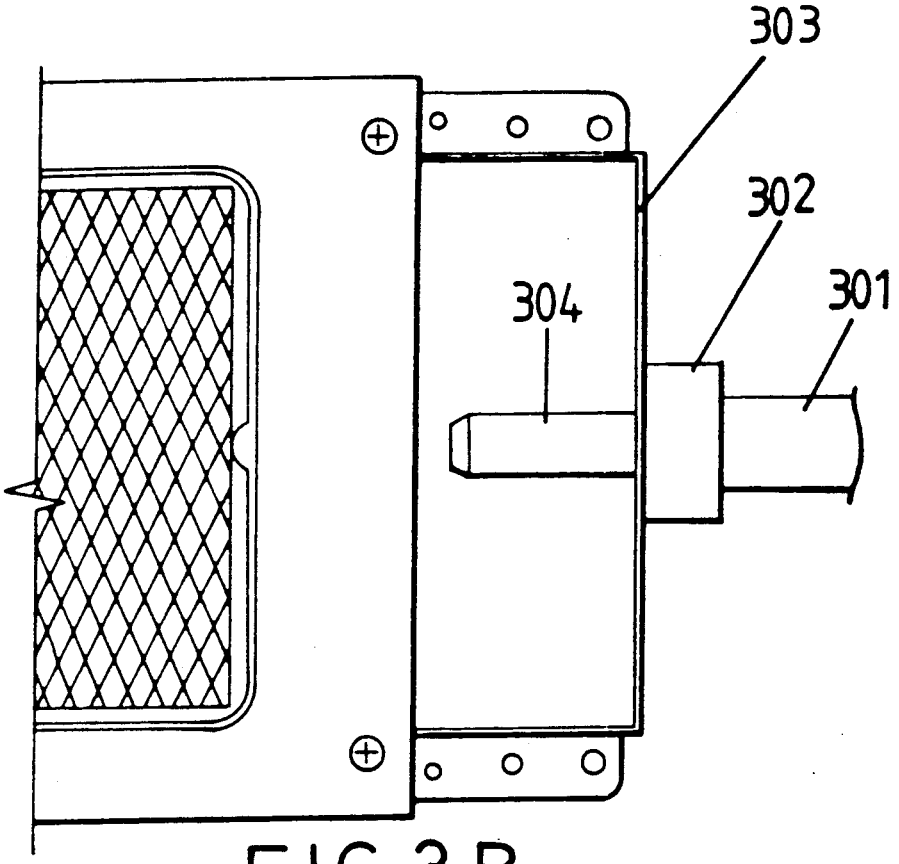
FIG 3A (PRIOR ART)
FIG. 3A is a plan view illustrating the assembly of a main nozzle and a main burner in the prior art.
Figure 3B:
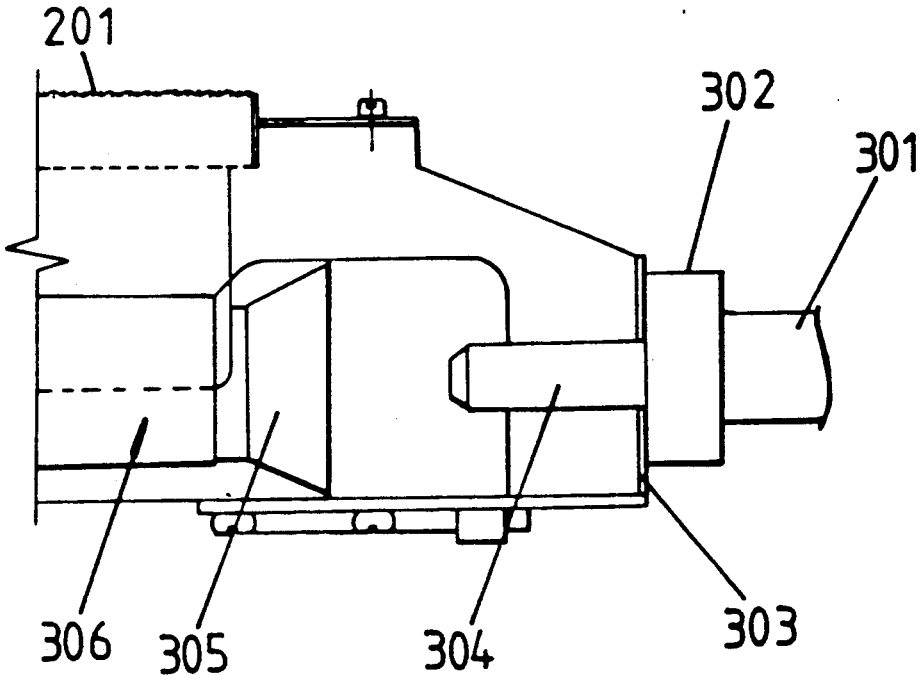
FIG. 3B is a side view illustrating the assembly of a main nozzle and a main burner of prior art.

FIG. 3A and FIG. 3B are views illustrating an assembly of a nozzle according to prior art.

Referring again to FIG. 1, gas is fed into governor body 103 through inlet 104 from a gas valve (not shown), gas is controlled by the elastic force of spring 106 which is controlled by control screw 105 of governor 101, diaphragm 108 contacts spring 106, valve stem 109 for acting as a controller of the gas intake volume communicates with diaphragm 108, gas controlled by valve stem 109 is supplied to a main burner (not shown) through main channel 112, and also gas taken in via inlet 104 is fed into a pilot burner (not shown) through second channel 111 and pilot gas channel 110.

In other words, only gas pressure for a main burner is controlled by governor 101 so that a constant gas pressure can be attained, while gas pressure for a pilot burner is not controlled by governor 101 so that a inconstant gas pressure at the pilot burner results.

FIG. 2 shows a schematic diagram of a circuit illustrating the foregoing structure of a gas stove.

A user pushes an ignition button to ignite an ignition burner 203 continuously for a predetermined period, whereby ignition plug 202 is sparked. While ignition burner 203 is ignited upon the opening of gas valve 207, main burner 201 and pilot burner 204 are ignited at the same time, together.

In this case, when thermocouple 205 as a safety device for extinguishing a flame is heated by the flame of pilot burner 204, it suddenly increases the electromotive force required for operating safety valve 206 and for maintaining an operating state of safety valve 206. Even if a user removes his finger from the surface of the button after a few seconds, gas valve 207 continues its open state due to the operation of safety valve 206. Therefore, a state of firing is continued, gas pressure for main burner 201 is controlled by governor 101, and thus main burner 201 receives gas fed under a predetermined pressure.

On the other hand, the differential phenomenon of gas pressure originating from governor 101 occurs at pilot burner 204, if the concentration of carbon, being mixed with the fuel gas, is at an atmosphere lower than a predetermined value. A lifting phenomenon, or incomplete combustion phenomenon, occurs due to a difference in the mixing ratio, and the flame state of pilot burner 204 is more incomplete than the flame state of main burner 201 owing to differential gas pressure of main burner 201 and pilot burner 204. As the incomplete state of the flame is detected by thermocouple 205, safety valve 206 is activated and thus the channel of gas valve 207 is shut off, and main burner 201 is extinguished.

FIG. 3A and FIG. 3B respectively, provide a plan view and a side view illustrating the assembly of a main nozzle and a main burner.

Gas supplied through flow tube 301 from a governor (not shown) is injected into mixing room 306 of main burner 201 by main nozzle 304 through venturi tube 305 positioned and spaced-apart therefrom. Due to the long length of flow tube 301, the gas pressure of gas to be supplied from the governor to main nozzle 304 through flow tube 301, which is controlled by the governor, slowly drops and leads to incomplete combustion.

Also, main nozzle 304 is coupled with flow tube 301 and the main nozzle 304 is installed on bracket 303 toward venturi tube 304 of main burner 201. During the assembly process, changes in the location of nozzle 304 often occur and cause it to slant. Due to the slant, the centerline of the injected flow into the venturi tube 305 from nozzle 304 is not coaxial with the centerline of venturi tube 305; this causes a disturbance in the injection flow. At that time, due to generation of an inertia flow, the steady axial flow in an inlet portion of venturi tube 305 can not be expected, and the distribution of the velocity of the gas flow is not uniformly symmetrically in a shape along the centerline of venturi tube 305. Consequently, a mixture of air around main nozzle 304 and the gas flow of main nozzle 304 improperly occurs; that is, mixed gas is fed into venturi tube 305 according to an improper mixing ratio. Incomplete combustion also occurs at main burner 201.

Figure 4:
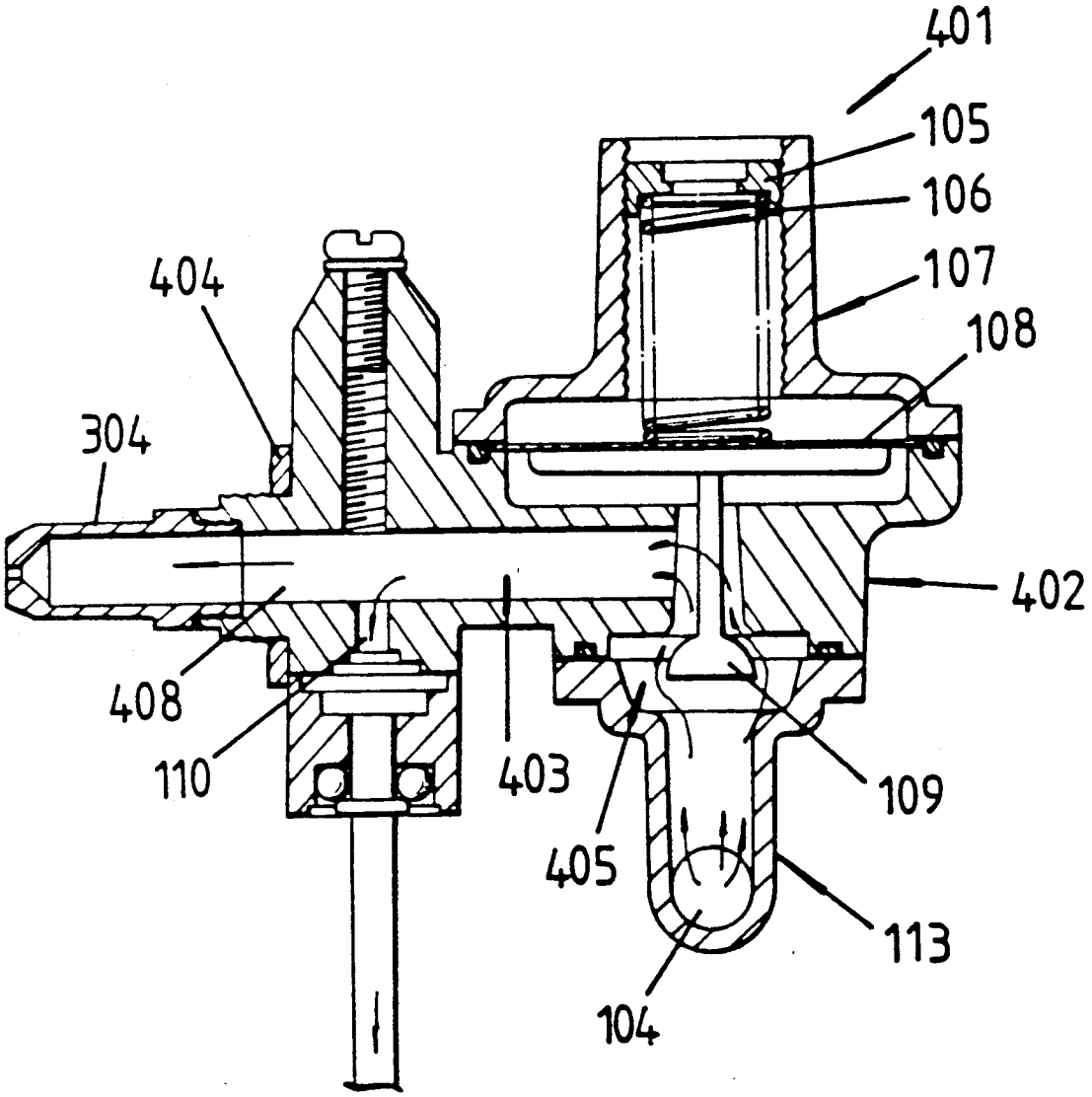
FIG. 4 is a sectional view illustrating a governor structure according to the priniciples of the present invention.
Figure 5:
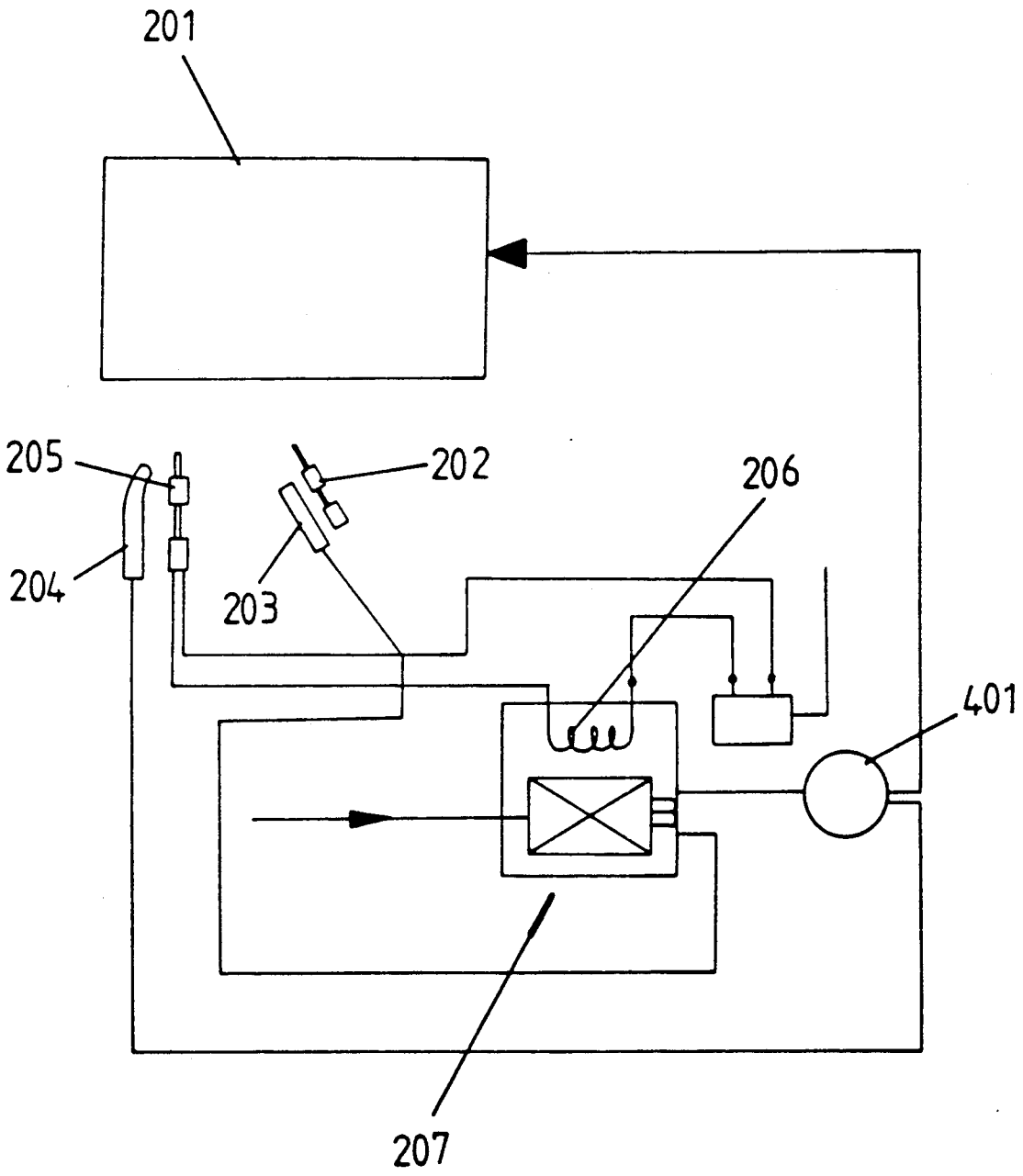
FIG. 5 is a schematic diagram of a gas supplying circuit including a gas stove and a safety apparatus according to the prinicples of the present invention.
Figure 6A:
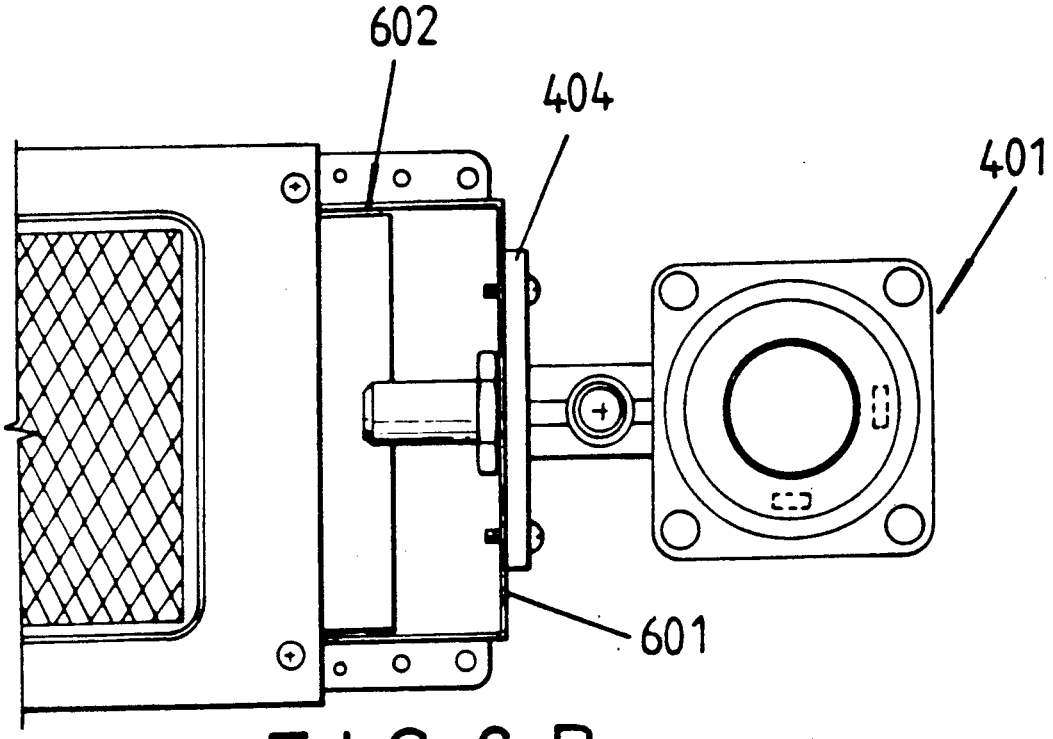
FIG. 6A is a plan view illustrating the assembly of a and a main burner according to the principles of the present invention.
Figure 6B:
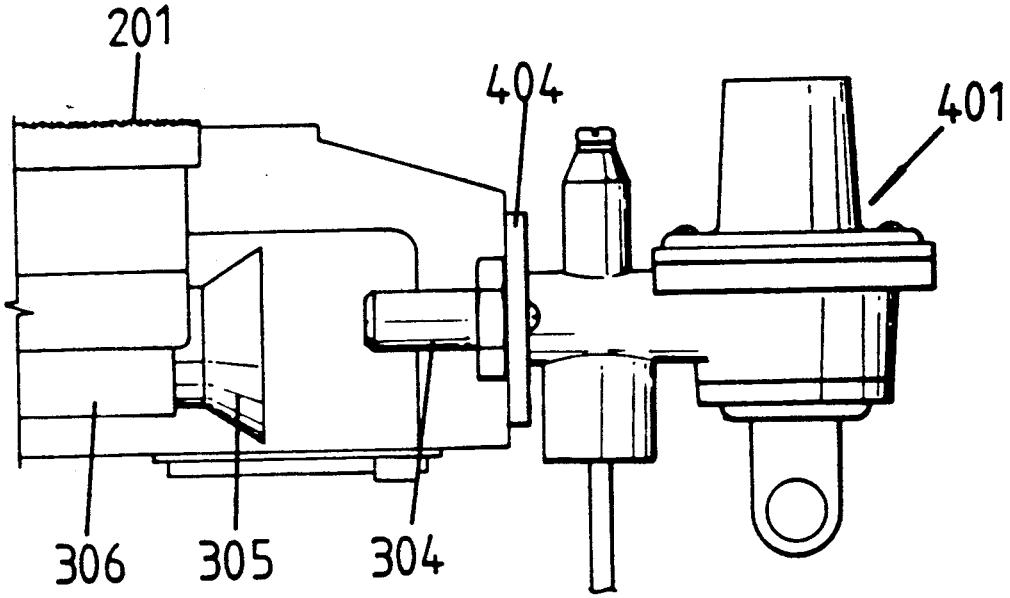
FIG. 6B is a side view illustrating the assembly of a main nozzle and a main burner according to the principles of the present invention.
Figure 7:
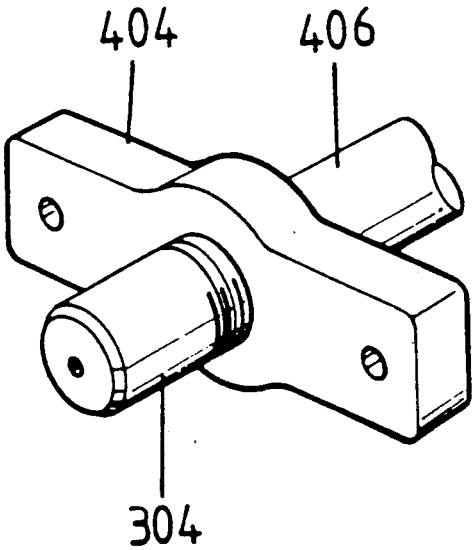
FIG. 7 is a perspective view showing an attachment for a governor according to the prinicples of the present invention.

Embodiments constructed according to the principles of the present invention are shown in FIG. 4, FIG. 5, FIG. 6A, FIG. 6B and FIG. 7. FIG. 4 and FIG. 5 provide views illustrating a governor structure and a circuit diagram thereof according to the principles of the present invention. FIG. 6A and FIG. 6B are views illustrating the assembly of a nozzle according to the principles of the present invention. FIG. 7 is a perspective view illustrating an attachment feature.

Governor 401 has housing 107, body 402, elbow 113, main burner nozzle 304 and flange 404. Hereinafter, the description for elements which may be the same as those of the prior art will be omitted. Body 402 contains valve stem 109 obtained in elbow 113, in which valve stem passes through body 402.

Body 402 includes common burner gas channel 403 placed in a direction perpendicular to the axial direction of valve stem 109, and a main burner gas channel 408 and a pilot burner gas channel 110 connected to common burner gas channel 402, which branch into two paths.

Gas taken in via inlet 104 of elbow 113 is fed into common burner gas channel 403 through first channel 405 placed around the circumference of valve stem 109 of housing 107. Gas received via common burner gas channel 403 branches into main burner gas channel 408 and pilot burner gas channel 110, individually, and is fed into main burner nozzle 304 and pilot burner nozzle 204 under predetermined constant pressure. In other words, the elastic force of spring 106 is controlled by the adjustment of control screw 105 which is contained in housing 107 belonging to governor 401. The pressure controlled by valve stem 109 in cooperation with diaphragm 108 is varied by the mutual action with gas pressure taken in from the outside. Gas fuel under a predetermined pressure is thus supplied to common burner gas channel 403 through first channel 405 formed as an open channel around the circumference of valve stem 109. Since common burner gas channel 403 is connected with main burner gas channel 408 and pilot burner gas channel 110, it is known that the gas fuel under the predetermined pressure is fed into main burner 201 and simultaneously into pilot burner 204 through the branched channel.

Also, due to the fact that fuel gas fed to main burner 201 and pilot burner 204 under constant pressure is supplied through governor 401 according to the principles of the present invention, gas is burned in a stable state at both main burner 201 and pilot burner 204.

Additionally, nozzle 304 is installed facing outwardly from venturi tube 305 of mixing room 306 so as to be in line with the centerline of mixing room 306 in main burner 201. Attachment feature 404 is formed integrally in the circumferential direction of main burner gas channel 408 of body 402. The flange of attachment feature 404 extends, by a predetermined length, in two or more directions from the outlet portion of main burner gas channel 408. At this time, the centerline of the flange formed on attachment feature 404 is placed in coaxial alignment with the center line of main burner gas channel 408. Consequently, the distance from the outlet of governor 401 to the inlet of main nozzle 304 can be minimized due to incorporation of main nozzle 304 and main burner gas channel 408 into a single body.

According to the principles of the present invention, in order to make the nozzle and the channel into one body, the threaded portion for coupling with main nozzle 304 is formed at the outlet portion of main burner gas channel 408. In another way, welding and casting may be used to make main nozzle 408 and body 402 into one body. That is, the centerline of main nozzle 304 is placed coaxially with the centerline of main burner gas channel 408 which is formed in body 402 to make main nozzle 304 and main burner gas channel 408 into one body.

Referring to FIG. 6A, reinforcing members 602 are provided at each end of bracket 601 located between main burner 201 and bracket 601. At this time, at the insert portion for venturi tube 305 formed on bracket 601, the centerline is placed in coaxial alignment with the centerline of venturi tube 305 in main burner 201. The flange of attachment feature 404 is superimposed on bracket 601, therefore the centerline of main nozzle 304 is in coaxially aligned with the centerline of bracket 601. Consequently, the centerline of the injected gas fuel flow from main nozzle 304 is put into the coaxial position along the center line of venturi tube 305, whereby a steady axial flow occurs to the inlet of venturi tube 305.

In connection with the embodiments shown in the foregoing drawings, and in accordance with the prinicples of the present invention, gas fed into pilot burner gas channel 110 as well as gas fed into main burner gas channel 408 is supplied through valve stem 109 of governor 401, so that the gas pressure for pilot burner 204 may be even and constant. Therefore, the safety extinguishment process in connection with the pilot burner assures the relativity given to the main burner while making the combustion of the constant gas pressure stable. Concurrently, because the direction of the gas injection is placed in the same line with the centerline of venturi tube 305, gas injected into venturi tube 305 from the center of main nozzle 304 and is fed into venturi tube 305 with a proper mixing ratio, thereby obtaining an effect of complete combustion at main burner 201. Also, by making main nozzle 304 and body 402 into one body, gas pressure for main nozzle 304 is maintained at a constant pressure without the pressure dropping, thereby enabling complete combustion.

What is claimed is:

1. A gas governor, comprising:

an elbow for receiving fuel gas, a body provided with a main burner gas channel and a pilot burner gas channel mounted therein connected to said elbow by a common burner gas channel, with said main burner gas channel and pilot burner gas channel being in communication with each other, a housing coupled to said body, a valve stem passing through said body and received in said elbow, a main burner nozzle having a centerline, said main burner nozzle being coupled to said body adjacent to a venturi tube of a main burner, said venturi tube having a centerline;

said common burner gas channel being positioned in a direction perpendicular to the axis of said valve stem;

valve means connected to said valve means, for regulating passage of fuel gas between said elbow and said common burner gas channel;

said main burner gas channel and pilot burner gas channel branching from said burner gas channel; and attachment means mounted at the outlet portion of said main burner gas channel for maintaining coaxial alignment between the centerline of said main burner nozzle and the centerline of the venturi tube.

2. A gas governor as claimed in claim 1, further comprised of said valve stem being mounted to supply gas introduced through said elbow to said common burner gas channel.

3. A gas governor as claimed in claim 1, further comprised of said attachment means having a flange extending a predetermined distance from two or more direction of the periphery adjacent to an outlet of said common burner gas channel.

4. A gas governor structure as claimed in claim 1, further comprised of the centerline of said attachment means coaxially aligned with said common burner gas channel.

5. A gas governor as claimed in claim 4, further comprised of the centerline of said main burner nozzle being coaxial with the centerline of said venturi tube.

6. A gas governor as claimed in claim 1, further comprised of said main burner nozzle being integrally mounted to the outlet of said common burner gas channel.

7. A gas governor as claimed in claim 6, further comprised of the center line of said main burner nozzle being coaxial with the centerline of said venturi tube.

8. A structure of a gas governor constituting a part of a gas stove, the improvement comprising:

an elbow for intaking fuel gas, a body coupled to one upper portion of the elbow and having a main burner gas channel and a pilot burner gas channel formed thereinside, said pilot burner gas channel being connectable to a pilot burner nozzle, said main burner gas channel terminating in a main nozzle positioned to eject fuel gas into a venturi tube of a main burner, a housing coupled to one upper portion of the body and having a valve stem controlled by a diagram thereinside, the valve stem extending from the elbow towards the housing;

said body comprising:

a common burner gas channel formed inside the body in a perpendicular arrangement extending away from the axis of the valve stem, for intaking the fuel gas;

the main burner gas channel having an entrance portion integrally connected to an exit portion of the common burner gas channel, and having an exit portion connected to the main nozzle with the central axis of the main nozzle being coaxially aligned with the central axis of the main burner gas channel, for feeding the fuel gas to the main nozzle;

the pilot burner gas channel connected integrally to the exit portion of the common burner gas channel and the entrance portion of the main burner gas channel, for feeding the gas to the pilot nozzle; and alignment means mounted integrally around a peripheral portion of an entrance portion in the main burner gas channel with the central axis of the alignment means being coaxially aligned with the central axis of the main nozzle, for coaxially aligning injection of gas from the main burner gas channel into the venturi tube via the main burner gas channel;

whereby gas pressure of gas injected from the pilot burner nozzle as well as the main burner nozzle is substantially constant.

9. A structure of a gas governor constituting a part of a gas stove, as claimed in claim 8, further comprised of said alignment means maintaining coaxial alignment between said central axis of said main nozzle and a central axis of the venture tube.

10. A structure of a gas governor constituting a part of a gas stove as claimed in claim 8, further comprised of means connected to said valve stem, for regulating passage of fuel gas between said elbow and said common burner gas channel.

11. A gas governor, comprising:

orifice means for receiving fuel gas;

means for providing a common gas channel, a main gas channel coupled to an exit portion of said common burner gas channel and a pilot gas channel coupled to said exit portion of said common gas channel;

means for regulating passage of fuel gas between said orifice means and an entrance portion of said common gas channel; and nozzle means connected to said main gas channel, for providing a passage for ejecting fuel gas from said main gas channel into a venture tube of a main burner;

said common gas channel having a central axis disposed in parallel alignment with a central axis of said main gas channel and a central axis of said passage of said nozzle means.

12. A gas governor as claimed in claim 11, further comprised of means for aligning said central axis of said main gas channel with a central axis of the venture tube.

13. A gas governor as claimed in claim 12, further comprised of said providing means forming a unitary body housing said common burner gas channel, said main burner gas channel, said pilot burner gas channel and said regulating means.

14. A gas governor as claimed in claim 12, further comprised of said central axis of said common gas channel said central axis of said main gas channel, said central axis of said passage being in approximately coaxial alignment.

15. A gas governor as claimed in claim 14, further comprised of said common gas channel, main gas channel and pilot gas channel are integrally formed by said providing means.

16. A gas governor as claimed in claim 12, further comprised of said central axis of said common gas channel said central axis of said main gas channel, said central axis of said passage being in approximately coaxial alignment.

17. A gas governor as claimed in claim 12, further comprised of said common gas channel, main gas channel and pilot gas channel are integrally formed by said providing means.

18. A gas governor as claimed in claim 11, further comprised of said providing means forming a unitary body housing said common burner gas channel, said main burner gas channel, said pilot burner gas channel and said regulating means.

19. A gas governor as claimed in claim 18, further comprised of said central axis of said common gas channel said central axis of said main gas channel, said central axis of said passage being in approximately coaxial alignment.

20. A gas governor as claimed in claim 11, further comprised of said common gas channel, main gas channel and pilot gas channel are integrally formed by said providing means.

* * * * *

UNITED STATES PATENT AND TRADEMARK OFFICE

CERTIFICATE OF CORRECTION

PATENT NO. : 5,097,818

DATED : 24 March 1992

INVENTOR(S) : Heui-Tae LEE et al.

It is certified that error appears in the above-identified patent and that said Letters Patent is hereby corrected as shown below:

Column 2, Line 50, insert --main nozzle-- after "a" (second occurrence).

Signed and Sealed this

First Day of June, 1993

Michael K. Kirk

*Attest:*

MICHAEL K. KIRK

*Attesting Officer*

*Acting Commissioner of Patents and Trademarks*